US007384570B2

(12) United States Patent
Marczak et al.

(10) Patent No.: US 7,384,570 B2
(45) **Date of Patent: *Jun. 10, 2008**

(54) ANODIZED ALUMINUM ETCHING PROCESS AND RELATED APPARATUS

(75) Inventors: Gregory S. Marczak, Fruitport, MI (US); Rick A. Minner, Muskegon, MI (US)

(73) Assignee: Lorin Industries, Inc., Muskegon, MI (US)

( * ) Notice: Subject to any disclaimer, the term of this patent is extended or adjusted under 35 U.S.C. 154(b) by 225 days.

This patent is subject to a terminal disclaimer.

(21) Appl. No.: 11/294,016

(22) Filed: Dec. 5, 2005

(65) Prior Publication Data

US 2006/0091111 A1 May 4, 2006

Related U.S. Application Data

(63) Continuation of application No. 09/899,591, filed on Jul. 5, 2001, now Pat. No. 7,029,597.

(60) Provisional application No. 60/263,408, filed on Jan. 23, 2001.

(51) Int. Cl.

| | |
|---|---|
| ***B44C 1/22*** | (2006.01) |
| ***C03C 15/00*** | (2006.01) |
| ***C03C 25/68*** | (2006.01) |
| ***C23F 1/00*** | (2006.01) |
| ***C25F 3/00*** | (2006.01) |

(52) U.S. Cl. ..... 216/102; 216/103

(58) Field of Classification Search ..... 216/2, 216/92, 102, 103, 104
See application file for complete search history.

(56) References Cited

U.S. PATENT DOCUMENTS 3,016,293 A * 1/1962 Cybriwsky et al. ..... 8/485

(Continued)

FOREIGN PATENT DOCUMENTS

GB 1079047 8/1967

(Continued)

OTHER PUBLICATIONS

Ahearn, J. et al, Correlation of Surface Chemistry and Durability of Aluminum/Polymer Bonds (1981).

(Continued)

*Primary Examiner*—Roberts Culbert
(74) *Attorney, Agent, or Firm*—Warner Norcross & Judd LLP

(57) ABSTRACT

A process for selectively etching a surface of an anodized aluminum article. A preferred process includes: providing an aluminum sheet or web including first and second sides having anodized finishes; etching the first side to improve the adhesion capabilities of that side but not etching the second side so that the second side retains its anodized finish. The anodized aluminum may be colored before etching, thus the second side retains its color after etching. In a more preferred embodiment, sodium hydroxide or phosphoric acid is used to etch the anodized aluminum. Optionally, the etching of the second side is prevented by administering gas or liquid over the second side, masking the second side with a protective film, or shielding the second side with a shield. Further, the gas or liquid administered over the second side may be controlled to increase or decrease the rate of etching on the first side.

21 Claims, 4 Drawing Sheets

U.S. PATENT DOCUMENTS

| | | | | |
|---|---|---|---|---|
| 3,622,472 | A | | 11/1971 | Izumikawa |
| 3,671,333 | A | | 6/1972 | Mosier |
| 3,776,783 | A | | 12/1973 | Venkata |
| 3,898,095 | A | | 8/1975 | Berdan et al. |
| 4,013,498 | A | | 3/1977 | Frantzen et al. |
| 4,124,437 | A | | 11/1978 | Bond et al. |
| 4,138,526 | A | | 2/1979 | Borresen |
| 4,215,194 | A | | 7/1980 | Shepherd |
| 4,235,682 | A | | 11/1980 | Schneeberger et al. |
| 4,338,007 | A | | 7/1982 | Fromson et al. |
| 4,367,122 | A | | 1/1983 | Bednarz |
| 4,398,994 | A | | 8/1983 | Beckett |
| 4,610,755 | A | * | 9/1986 | Beckett ..... 216/91 |
| 4,618,405 | A | | 10/1986 | Mohr |
| 4,624,752 | A | | 11/1986 | Arrowsmith et al. |
| 5,367,196 | A | | 11/1994 | Mahulikar et al. |
| 5,945,351 | A | | 8/1999 | Mathuni |
| 7,029,597 | B2 | * | 4/2006 | Marczak et al. ..... 216/102 |

FOREIGN PATENT DOCUMENTS

| | | |
|---|---|---|
| JP | 62-151578 | 7/1987 |

OTHER PUBLICATIONS

Arrowsmith, D. et al, The Enhancement of Adhesive Joint Strength by Extending the Surface of Anodized Aluminum (1992).

Bishop, J., Novel Surface and Interfacial Analysis Techniques to Aid in Specific Areas of Adhesive Development (1984).

Brockman, W, Possibilities of Increasing the Stability of Adhesion in Metal Bonds (1978).

Omata, K, Adhesion of Paint Films to Anodic-Oxide Films on Aluminum (1981).

* cited by examiner

ANODIZED ALUMINUM ETCHING PROCESS AND RELATED APPARATUS

This is a continuation of U.S. application Ser. No. 09/899,591 filed Jul. 5, 2001 (now U.S. Pat. No. 7,029,597), which claims the benefit of U.S. Provisional Application No. 60/263,408, filed Jan. 23, 2001.

BACKGROUND

The present invention relates to a process for manufacturing anodized, colored aluminum.

Anodized aluminum is used in a variety of applications including building materials, household appliances, automotive trim, foil applications, farm equipment, furniture, sporting goods, and containers. Anodized aluminum products are desirable because they exhibit many beneficial functional characteristics such as: resistance to corrosion, chemical staining, and fading; electrical insulation; and exceptional structural rigidity.

Currently, most anodized aluminum is manufactured in two-sided sheet or coil form, where (1) both sides of the sheet or coil are anodized with a sulfuric acid anodizing process or (2) both sides of the sheet or coil are anodized with a phosphoric acid anodizing process. Sulfuric acid anodized aluminum is readily colored, and therefore is suitable for applications requiring a decorative finish. However, conventional sulfuric acid anodized aluminum is incompatible with most commercially available adhesives. Accordingly, it is difficult to adhere sheets of decoratively finished sulfuric acid anodized aluminum to other materials.

In contrast, phosphoric acid anodized aluminum satisfactorily bonds with commercially available adhesives, and thus is a good candidate for applications where anodized aluminum sheets must be adhered to other materials. However, phosphoric acid anodized aluminum is difficult to color. Accordingly, although the phosphoric acid anodized acid sheets are readily bonded with other materials, the color of the sheets is limited to a dull-grayish finish.

A drawback of conventional anodizing processes is that both sides of manufactured sheets and coils of anodized aluminum either exhibit the desirable decorative function of sulfuric anodized aluminum or exhibit the desirable enhanced adhesion characteristics of phosphoric acid anodized aluminum. As a result, in many applications of anodized aluminum, one must weigh the trade-off between the decorative function and the adhesion characteristics.

SUMMARY OF THE INVENTION

The aforementioned problems are overcome in the present invention that provides an etching process in which one side of an anodized aluminum web or sheet is etched to form an improved adhesion surface and the other side of the web or sheet retains its pre-etching finish.

In a preferred embodiment, the present invention generally includes: providing a web or sheet of aluminum, anodized on both sides, and etching one side of the web. Preferably, etching creates an improved adhesion surface on the etched side, referred to as the "bond side," but does not affect the other side of the web or sheet. Thus, the other side of the web or sheet retains its pre-etch finish, which is preferably decorative. The un-etched side is typically referred to as the "show side" because it is usually viewable or shown.

Etching creates many minute protrusions and superficial pockets or pores on or in the surface of the anodized aluminum. In effect, the surface area of this anodized aluminum significantly increases. Thus, adhesive applied over this roughened and increased surface readily bonds mechanically to the structures. Because of this mechanical bonding, the resultant etched surface of the anodized aluminum exhibits superior adhesion and bonding strength.

Etching is carried out by applying an etching composition to the bond side of the sheet or web. A preferred etching composition is a solution of sodium hydroxide, however, other compositions may be used, for example any alkaline or acidic media that is capable of dissolving aluminum oxide. Optionally, the composition is prevented from contacting the show side by techniques including: blowing air against the show side; administering a liquid over the show side; masking the show side with a film or sheet; and/or protecting the show side with a shield adjacent the show side.

The etching composition, preferably in a solution form, may be applied to the future bond side of the web or sheet in a variety of manners, for example: by cascading the etching solution over the bond side; by misting the etching solution over the bond side; by spraying the etching solution onto the bond side; by dipping the sheet or web into the etching solution where the show side is covered with a film and the bond side is exposed; and by rolling or brushing the etching solution onto the bond side.

Optionally, heat or temperature regulated air flow may be applied on the show side to affect the etching process on the bond side of the sheet.

The present inventive process, related apparatus and resultant product provide a significant benefit in that it is now possible create anodized aluminum sheets and webs that include both a decorative side and a bonding side with superior bonding capabilities.

These and other objects, advantages and features of the invention will be more readily understood and appreciated by reference to the detailed description of the preferred embodiments and the drawings.

DETAILED DESCRIPTION OF THE PREFERRED EMBODIMENTS

I. Etching

Figure 1:
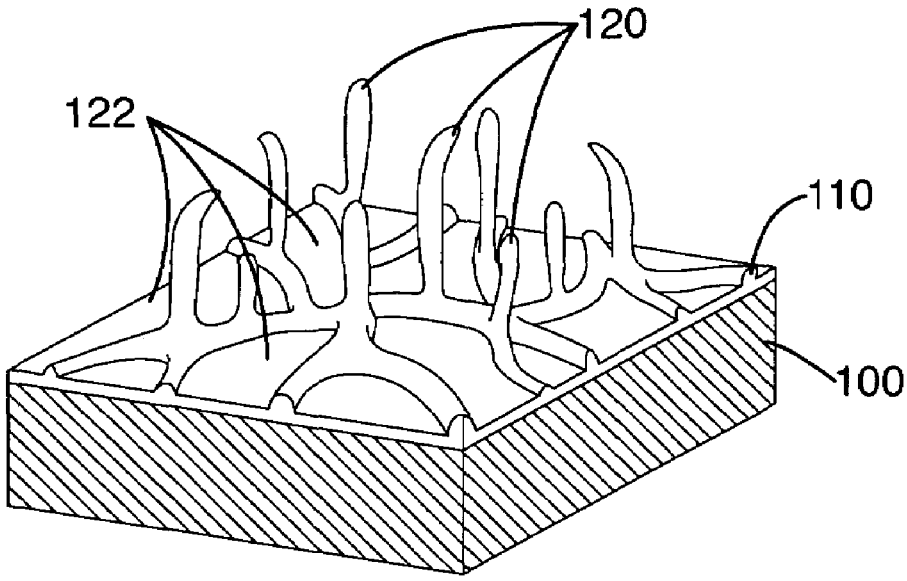
FIG. 1 shows a microscopic perspective view of an anodized aluminum surface etched with an etching composition according to a preferred embodiment of the present invention.
Figure 2:
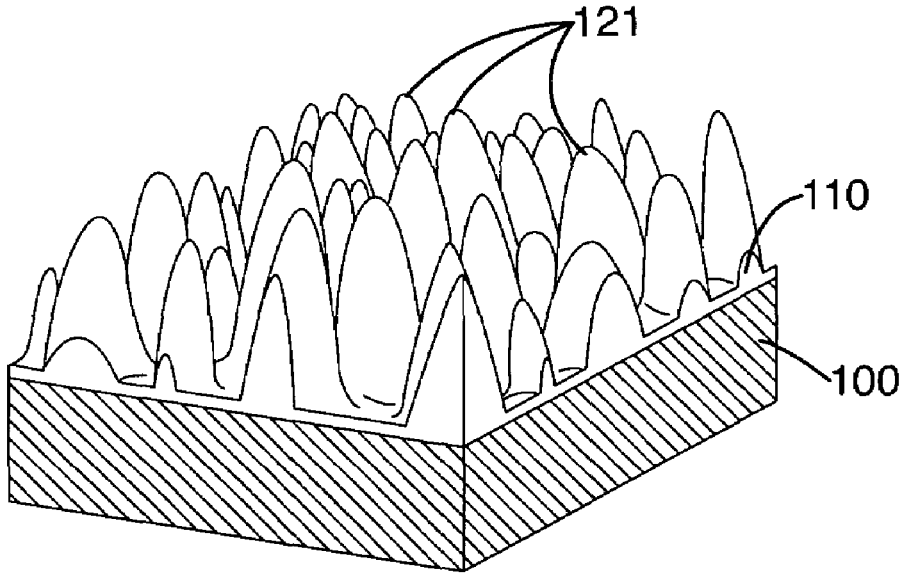
FIG. 2 is a microscopic perspective view of an anodized aluminum surface etched with a second etching composition.

FIGS. 1 and 2 depict anodized aluminum surfaces that have been etched according to the present invention. "Etching" is a chemical treatment whereby an etching composition is applied to and partially dissolves an anodic film or layer on an anodized aluminum surface to create a roughened morphology. An "etching composition" is any alkaline or acidic media capable of dissolving aluminum oxide, including but not limited to sodium hydroxide, calcium hydroxide, phosphoric acid, hydrofluoric acid, sulfuric acid, bromic acid and chromic acid. "Roughened morphology" refers to a condition where the anodic film of the anodized aluminum includes an extended or protruded surface area, which provides many sites for an increased number of mechanical—and in some cases chemical—bonds between the anodic layer and an adhesive applied over the anodic film. The roughened morphology may resemble the surfaces depicted in FIGS. 1 and 2, or other configurations depending on the etching solution applied, the duration of application and temperature.

In the present invention, the etching composition may be a solution of water or other suitable liquid and an alkaline, acidic or other caustic material, capable of dissolving aluminum oxide referred to as an "etching solution." A preferred etching solution is a solution of sodium hydroxide of about 0.1 to about 0.5 molar. Optionally, sodium hydroxide solutions of about 0.5 to about 1.5 molar, and 1.0 to about 4 molar may also be used. Alternatively, the etching solution may be a solution of phosphoric acid in concentrations of preferably about 0.1 to about 5.1 molar, more preferably about 0.5 to about 3.0 molar and most preferably about 0.75 to about 1.5 molar. As will be appreciated, solutions of sulfuric acid may also be used, however, the temperature and duration of time required to sufficiently dissolve an aluminum oxide layer must be significantly increased relative to the temperature and duration required with sodium hydroxide solutions and phosphoric acid solutions.

With reference to FIG. 1, the anodic layer 110 of the anodized aluminum, includes a plurality of protrusions 120 and depression areas or cells 122 created by the etching process described above. The structure of FIG. 1, which typically is created when using a sodium hydroxide etching solution, may also be referred to as scallops 122 with nodular protrusions 120. The anodic layer 110, which is etched to form the roughened morphology, is a stable film of oxides, also referred to as an oxide layer, for example, aluminum oxide, formed on the surface of aluminum. Aluminum 100 may be any aluminum or alloy including aluminum. The anodic layer 110 preferably is created with commercially known sulfuric acid or phosphoric acid anodizing processes. The pre-etched anodic film is preferably greater than 0.1 mils (thousandths of an inch) or about 2.54 microns in depth. Films less than 0.1 mils will work, but the height and depth of nodular protrusions and scallops respectively may not be as great as with thicker anodic films.

The structure of FIG. 2, which typically is created when using a relatively high molarity sodium hydroxide etching solution, shows a second morphology of an anodized aluminum surface including a plurality of spike-like protrusions 121 on an anodic layer 110 of aluminum 100. In this morphology, the spike-like protrusions which make up the bonding layer may be about 1 to about 20 nanometers, preferably 2 to about 10 nanometers, and most preferably about 5 to about 6 nanometers in depth from the top to the base of the spikes. Other roughened morphologies that increase the potential for mechanical interlocking of an adhesive to the anodic layer, are acceptable in addition to those depicted in FIGS. 1 and 2.

II. Preferred Embodiment of the Etching System

Figure 3:
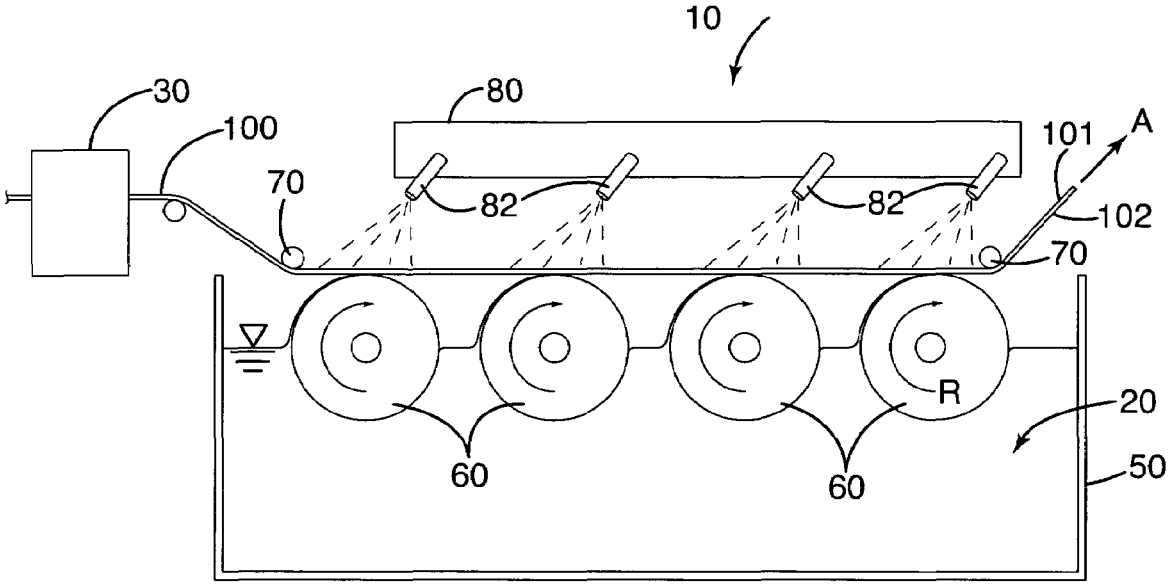
FIG. 3 is a side view of a preferred embodiment of an etching system of the present invention and a web being etched thereby.

A preferred embodiment of an etching system 10 for applying etching compositions to a web is depicted in FIG. 3. The etching system 10 generally includes application rollers 60, guides 70 and tank 50 filled with an etching composition or solution 20 as described above.

Unless otherwise specified, as used herein, "web" means a length of aluminum including top and bottom surfaces anodized before treatment in the tank 50. The anodizing of raw aluminum may occur at the anodizing station 30 (which is shown in a condensed form). The surfaces may be anodized using a conventional anodizing process such as sulfuric acid anodizing or phosphoric acid anodizing. In the preferred embodiment, the web is sulfuric acid anodized with a sulfuric acid concentration preferably of about 50 to 100 grams per liter, and more preferably about 150 to 400 grams per liter. As will be appreciated, sheets of anodized aluminum and individual pieces of aluminum structures may be etched in a manner similar to that described herein in connection with the web.

Preferably, before introduction to the tank 50, the web 100 is colored or sealed according to commercially acceptable coloring and sealing practices. The coloring and/or sealing may also occur at station 30 which, for purposes of disclosure, may comprise one or more individual stations, for example an anodizing station, a coloring station and/or a sealing station. If colored, both surfaces of the web is colored. Optionally, the web 100 also may be brightened, polished, cleaned or desmutted using commercially acceptable methods before introduction into the tank 50.

The etching system of FIG. 3 particularly includes guides 70, which direct web 100 of an anodized aluminum over and in contact with rollers 60. Rollers 60 rotate as indicated by arrows R as web 100 is pulled in direction of advancement A. The rollers 60 may or may not be powered to rotate as the web 100 advances. As shown, rollers 100 are partially submersed in etching solution 20. Optionally, the rollers 60 may be substituted with a device, for example a brush that contacts the web and transfers etching solution 20 to one side of the web but not the other. Although not shown, the web of the embodiments disclosed herein may be pulled or otherwise advanced through an etching system with a coiling system or with any commercially available advancing system.

In the preferred embodiment, the etching solution 20 is a solution of sodium hydroxide having a concentration of about 0.05 to about 5 molar, preferably 0.1 to about 2 molar and more preferably about 0.1 to about 0.5 molar. Optionally, other caustic etching compositions at other concentrations may also be used as desired.

The etching system 10 may also include a diverter 80 to prevent etching solution 20 from contacting the upper surface 101 of the web. In one embodiment, the diverter 80 is a blower that blows a gas, for example, air, through ports 82 onto the upper side 101 and prevents etching solution 20 from etching that upper side. Optionally, the blower 80 may be replaced with a sprayer or mister that sprays or mists a liquid, such as water, through ports 82 onto the upper side 101 and prevents etching solution 20 from etching that upper side. Further, the blower or sprayer or mister may include a temperature-regulating element to heat or cool the gas or liquid dispelled therefrom. Temperature regulation may be used to further control the etching process on the underside 102 of the web. For example, the air may be heated to speed-up the caustic action of the etching composition on the underside 102 of the web. The exact amount of heat or cooling applied to the web may be monitored and controlled to etch the web as desired.

In another embodiment, the upper side 101 may be masked with a plastic or other synthetic film (not shown). Alternatively, a protective shield (not shown) constructed of a material such as plastic or non-corrosive metal, may be disposed adjacent the upper side 101 of the web 100. Of course, sometimes the film may not entirely contact or the shield may not fully cover the upper side 101. Thus, portions of the upper side 101 may become contaminated with etching solution. These portions optionally may be trimmed from the web 100 as desired. As will be appreciated, trimming may be utilized in any embodiment disclosed herein.

The operation of the etching apparatus of FIG. 3 will now be described. In general, the etching apparatus 10 provides a continuous web, sheet or article of aluminum including a first anodized side and a second anodized side and selectively etches the first side but not the second side. With more particularity, the dual-sided anodized web 100 is fed by guides over rollers 60 in the etching solution tank 50. As the web 100 is guided over the rollers 60, the rollers roll and cause the etching solution 20 in which they are partially submersed rides-up the surface of the roller 60. At the point of contact of the rollers 60 and the web 100, the etching solution 20 is applied to the lower surface or underside 102 of the web. Because the etching solution 20 is not affirmatively applied to the upper surface of the web 101, that surface is not etched.

Preferably, the lower surface 102 of the anodized aluminum web 100 is exposed to the etching solution for about 1 to about 240 seconds, more preferably about 10 to about 100 seconds and most preferably about 20 to about 60 seconds. The temperature of the etching solution is preferably 50° F. to about 300° F., more preferably 10° F. 0 to about 212° F., and most preferably about 70° F. to about 160° F. Of course, the temperature and exposure time may vary according to the concentration of the caustic composition and the desired degree of etching.

Optionally, the etching solution 20 may be prevented from contacting the upper surface 101 during application by blowing, spraying, misting or applying a gas or liquid with diverter 80 over upper surface 101, applying a film to the upper surface 101, or using a protective shield over upper surface 101 as explained above.

Notably, after traversing the etching system 10, the upper surface 101 of the web, also referred to as the "show side," is un-etched, however, the lower surface 102 of the web, also referred to as the "sticky side" or "bond side" is etched.

III. First Alternative Embodiment the Etching System

Figure 4:
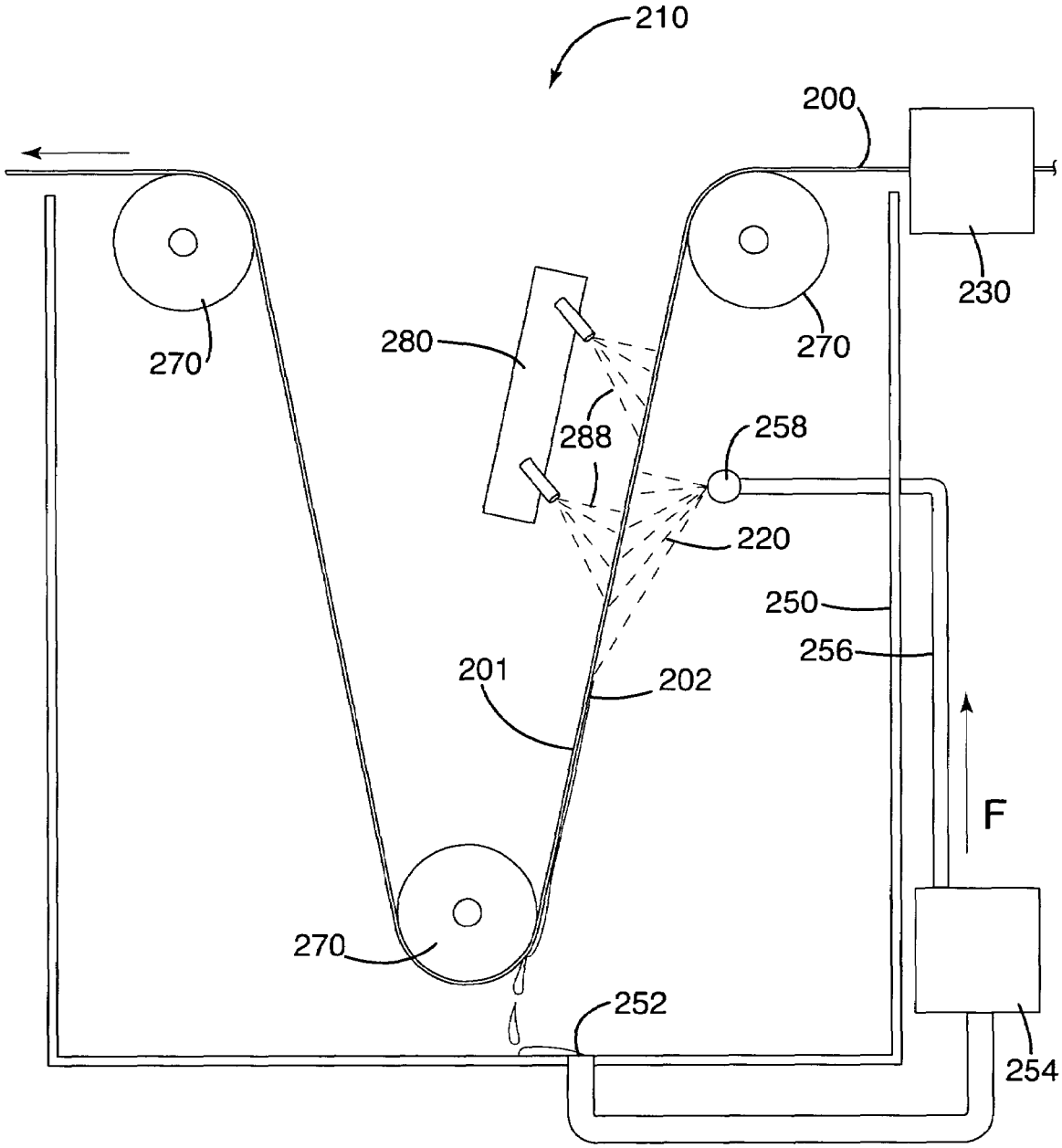
FIG. 4 is a side view of a first alternative embodiment of an etching system.

FIG. 4 shows a first alternative embodiment of the etching system 210 used to selectively etch a first side of an anodized aluminum web but not the second side. The etching system 210 generally includes a tank 250, guides 270, etching composition applicator 258 and diverter 280. Web 200 is wound over guides 270 in the tank 250. Applicator 258 applies an etching composition in the form of a liquid or vapor to the underside 202 of the web. The etching composition may be any of the etching compositions described in connection with the preferred embodiment. The etching solution 220 may be cascaded down and over the underside 202 to etch that side. Optionally, the applicator 258 may mist or spray the etching solution 220 onto the web as desired. Further, the applicator 258 may be substituted with rollers or brushes (not shown) disposed adjacent and in contact with the web to apply the etching solution thereto. These rollers or brushes may have etching composition disposed on or in them so that upon contact with the web, the etching composition is transferred and applied to the underside 202.

The tank 250 optionally includes an etching composition diverter 280, which is similar in structure and operation to the preferred embodiment, and therefore will not be explained in detail here. Alternatively, the diverter 280 may be substituted with a shield member (not shown) disposed over the upper surface 201 of the web, or the upper surface 201 may be coated or covered with a plastic or other synthetic film (not shown) to prevent the etching solution from contacting the upper surface 201 as described in the preferred embodiment above.

The etching system 210 may further include a drain 252, pump 254 and back flow line 256 to circulate etching solution 220 in the form of a liquid for re-use. An anodizing, coloring and/or sealing station 230 may be upstream of the tank 250 to perform the anodizing, coloring and/or sealing of a raw aluminum web before the web advances to the tank 250.

The operation of the first alternative embodiment of the etching system 210 in FIG. 4 is similar in nature to the operation of the preferred embodiment and will only be explained briefly here. Web 200 feeds over guides 270 and etching solution 220 is applied to etch the underside 202 with etching compound applicator 258 by cascading, misting, spraying, rolling or brushing techniques. Optionally, the etching composition 220 is prevented from the contacting the show side 101 by administering a fluid 288, which may be liquid or gas, over the upper side 201 as the etching solution 220 is applied to the underside 202. Optionally, a film or protective shield (not shown) may be used as described above in connection with the preferred embodiment.

In the embodiment depicted in FIG. 4, the underside 202 of the web may be exposed to the etching solution for the periods and temperatures explained above in the preferred embodiment. Depending on the degree of etching and the type of etching composition used, concentration, exposure time and temperature may be altered as desired.

IV. Second Alternative Embodiment of the Etching System

Figure 5:
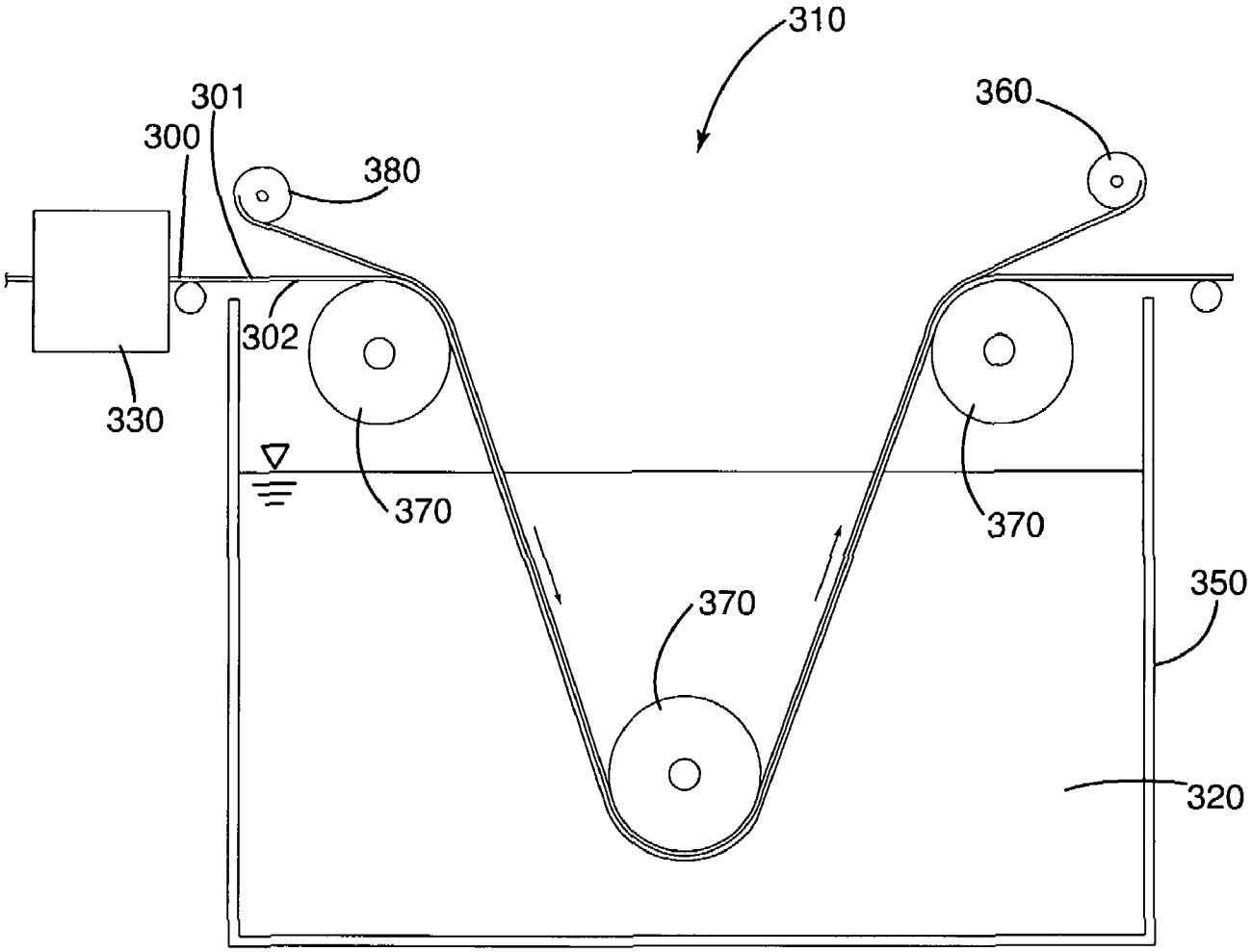
FIG. 5 is a side view of a second alternative embodiment of the etching system.

FIG. 5 depicts a second alternative embodiment of an etching system 310 which generally includes guides 370, tank 350 filled with etching composition 320, film applicator 380 and optionally film rewind 360. An anodizing, coloring and/or sealing station 330 may be upstream of the tank 350 to perform the anodizing, coloring and/or sealing of a raw aluminum web before the web advances to the tank 350.

In operation, before the anodized web 300 is guided through the etching solution 320 in the tank 350, the upper side 301 is masked with a polyfilm such as a conventional plastic or synthetic film, coating or covering. The etching solution may be any of the etching compositions described in connection with the preferred embodiment. When the web 300 is guided through the etching solution 320, only the under side 302 comes into contact with the etching solution 320 to become etched.

In the embodiment depicted in FIG. 5, the underside of the web 302 may be exposed to the etching solution for the periods and temperatures explained above in the preferred embodiment. Depending on the degree of etching and the type of etching composition used, concentration, exposure time and temperature may be altered as desired.

V. Comparative Example

A sulfuric acid anodized web was selectively etched on one side with 0.1 molar sodium hydroxide for 30-60 seconds at 140° F. After removing excess sodium hydroxide from the etched side with nitric acid, the adhesion strength of the etched side preparation was compared with alternate preparations of (1) sulfuric acid anodized aluminum and (2) sulfuric acid anodized aluminum coated with a conventional chromic acid conversion treatment. Conventional ASTM D1876 testing methods were observed in carrying out the comparative test. For this test, a 1 ml layer of 3MDP430 epoxy adhesive, available from 3M Corporation of St. Paul, Minn., was applied to a piece of sample material of each of the alternate preparations. A second piece of like material was then secured to each sample piece. For example, the sulfuric acid anodized piece was mated to a like sulfuric acid anodized piece, and so on. But for the selectively etched pieces prepared according to the process of the present invention, the sample and like piece were mated so the etched surfaces of the samples faced each other.

Next, the adhesive was cured at 235° F. for one hour. Each sample of material was cut into 1 inch wide t-peel specimens and subjected to a tensile pull tester operating with a crosshead speed of 10 inches per minute. The comparative results of the tensile pull test are presented in Table I below.

TABLE I

Tensile Pull Test Results

| Sample | Peel Results at 10 inches/minute crosshead speed |
|---|---|
| Single-side Sodium Hydroxide Etched | 30-60 lbs./in. before cohesive failure |
| Dual-sided Sulfuric Acid Anodized Sample | >3 lbs./in. before adhesive failure |
| Dual-sided Chromic Conversion Sample | >6 lbs./in. before adhesive failure |

As Table I demonstrates, the anodized aluminum treated with sodium hydroxide etching solution of the preferred embodiment exhibits superior failure thresholds when compared to sulfuric acid anodized aluminum and chromate conversion aluminum specimens. Specifically, the single-sided sodium hydroxide etched samples exhibited cohesive failure at around 30-60 lb./in., meaning the epoxy adhesive itself failed and was torn apart, leaving pieces of epoxy on both strips of pulled-apart sample. In contrast, the dual-sided sulfuric acid anodized sample and dual-sided chromic conversion sample exhibited adhesive failure at less than 3 lbs./in. and less than 6 lbs./in., respectively, meaning the epoxy adhesive did not fail, but was pulled-off from the surface of at least one surface of adjoining sample strips.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A process for modifying a continuous web of aluminum comprising:

anodizing a continuous web of aluminum including a first side and a second side to create an anodic layer on each of the first side and the second side;

sealing the anodic layer;

applying a composition comprising sodium hydroxide to the first side to selectively etch the first side, but not the second side, wherein the composition dissolves a first portion of the anodic layer on the first side, wherein the anodic layer on the second side remains undissolved by the composition.

2. The process of claim 1 comprising preventing the etching composition from contacting the second side by applying fluids against the second side.

3. The process of claim 1 comprising preventing the etching composition from contacting the second side by masking the second side with a film or sheet.

4. The process of claim 1 wherein the etching composition is applied to the first side by an application technique selected from cascading, misting, spraying, dipping, rolling, and brushing.

5. The process of claim 1 wherein the first side includes an anodic layer and the etching composition dissolves the anodic layer so that the anodic layer includes a bonding layer of about 4-10 nanometers in depth.

6. The process of claim 1 wherein said sealing is performed before said applying step.

7. The process of claim 6 wherein the sodium hydroxide is about 0.1 molar to about 0.5 molar.

8. The process of claim 7 wherein the first side is exposed to the etching composition for about 20 to about 60 seconds.

9. A process for modifying an aluminum article comprising:

anodizing an aluminum article to produce first and second surfaces, each including an anodic layer;

sealing the anodic layer of the first and second surfaces;

applying an etching composition to the first surface to remove a portion of the anodic layer from only the first surface so that a remaining portion of the anodic layer of the first surface is transformed to attain a roughened morphology including a plurality of protrusions to improve the adhesive strength of the first surface; and preventing the etching composition from etching the second surface of the article.

10. The process of claim 9 wherein the etching composition is a solution including chemicals selected from sodium hydroxide, phosphoric acid, calcium hydroxide, hydrofluoric acid, sulfuric acid, bromic acid and chromic acid.

11. The process of claim 9 wherein the etching composition is applied to the first anodized surface with application techniques selected from cascading, misting, spraying, rolling, brushing and dipping.

12. A process for modifying an aluminum article comprising:

anodizing an aluminum article to produce first and second surfaces, each including an anodic layer;

sealing the anodic layer of the first and second surfaces;

applying an etching composition to the first surface to remove a portion of the anodic layer from only the first surface, thereby creating a plurality of protrusions to improve the adhesive strength of the first surface; and preventing the etching composition from etching the second surface of the article, wherein the etching composition is prevented from contacting the other anodized surfaces by masking the second surface with a film or sheet.

13. A process for modifying an aluminum article comprising:

anodizing an aluminum article to produce first and second surfaces, each including an anodic layer;

sealing the anodic layer of the first and second surfaces;

applying an etching composition to the first surface to remove a portion of the anodic layer from only the first surface, thereby creating a plurality of protrusions to improve the adhesive strength of the first surface; and preventing the etching composition from etching the second surface of the article, wherein the etching composition is prevented from contacting the other anodized surfaces by blowing a gas against the second surface.

14. A process for modifying an aluminum article comprising:

anodizing an aluminum article to produce first and second surfaces, each including an anodic layer;

sealing the anodic layer of the first and second surfaces;

applying an etching composition to the first surface to remove a portion of the anodic layer from only the first surface, thereby creating a plurality of protrusions to improve the adhesive strength of the first surface; and preventing the etching composition from etching the second surface of the article, wherein the etching composition is prevented from contacting the second surface by cascading a liquid over the second surface.

15. The process of claim 9 wherein the aluminum article is at least one of a web and a sheet.

16. The process of claim 15 wherein the etching composition is applied to the aluminum article by advancing the aluminum article over a plurality of rolling members including surfaces having etching composition thereon.

17. A process for modifying aluminum sheets or webs comprising:

providing an aluminum sheet or web, anodizing the aluminum sheet or web to produce a first anodized surface and a second anodized surface, each including an anodic layer having an original surface area;

sealing the anodic layer; and administering a caustic solution to the first anodized surface, but not the second anodized surface so that the caustic solution dissolves the anodic layer of the first anodic surface to create a roughened morphology including a plurality of protrusions extending from a remaining portion of the anodic layer to provide an adhesion surface having more surface area than the original surface area.

18. The process of claim 17 comprising preventing the caustic solution from contacting the second anodized surface.

19. The process of claim 17 comprising applying the caustic solution to the first anodized surface by at least one of cascading, misting, spraying, dipping, rolling and brushing.

20. The process of claim 17 wherein the caustic solution includes at least one of phosphoric acid, sodium hydroxide, calcium hydroxide, hydrofluoric acid, sulfuric acid, bromic acid and chromic acid.

21. The process of claim 20 wherein the caustic solution is applied at a temperature ranging from about 60° F. to about 212° F.

* * * * *